US009312625B2

(12) United States Patent
Shen

(10) Patent No.: US 9,312,625 B2
(45) Date of Patent: Apr. 12, 2016

(54) SHIELDING STRUCTURE OF SAFETY SOCKET

(71) Applicant: Yang Ji Co., Ltd., New Taipei (TW)

(72) Inventor: Su-Chen Shen, New Taipei (TW)

(73) Assignee: Yang Ji Co., Ltd., New Taipei (TW)

( * ) Notice: Subject to any disclaimer, the term of this patent is extended or adjusted under 35 U.S.C. 154(b) by 2 days.

(21) Appl. No.: 14/452,543

(22) Filed: Aug. 6, 2014

(65) Prior Publication Data

US 2016/0043496 A1 Feb. 11, 2016

(51) Int. Cl.
*H01R 13/44* (2006.01)
*H01R 13/60* (2006.01)
*H01R 13/453* (2006.01)

(52) U.S. Cl.
CPC ..... *H01R 13/4534* (2013.01)

(58) Field of Classification Search
CPC ..... H01R 13/514; H01R 31/06
USPC ..... 439/137, 138, 140, 136, 142, 145
See application file for complete search history.

(56) References Cited

U.S. PATENT DOCUMENTS 5,702,259 A * 12/1997 Lee ..... H01R 13/4534 439/137
6,776,630 B1 * 8/2004 Huang ..... H01R 13/4534 439/137
6,893,275 B2 * 5/2005 Ng ..... H01R 13/4534 439/137
7,527,508 B1 * 5/2009 Lee ..... H01R 13/4534 439/137
7,637,756 B1 * 12/2009 Hsu ..... H01R 13/4534 439/137
7,914,307 B1 * 3/2011 Yang ..... H01R 13/4534 439/137
2013/0189864 A1 * 7/2013 Chen ..... H01R 13/453 439/136
2013/0316589 A1 * 11/2013 Lee ..... H01R 27/02 439/653

* cited by examiner

*Primary Examiner* — Abdullah Riyami
*Assistant Examiner* — Harshad Patel
(74) *Attorney, Agent, or Firm* — Leong C. Lei

(57) ABSTRACT

A safety socket includes hot/neutral slots formed in a bottom of the safety socket, a movable shielding member arranged in the safety socket to correspond to the hot/neutral slots, and an elastic element having two ends respectively fixed to the movable shielding member and a top of the safety socket. With such an arrangement, when the hot/neutral slots simultaneously receive plug prongs to insert therein, the movable shielding member is caused to move toward the top of the safety socket and when the plug prongs are withdrawn, the movable shielding member is returned by elasticity of the elastic element to shield the hot/neutral slots. Through such an operation, the moving direction of the movable shielding member is changeable so that unnecessary space of the safety socket can be eliminate to overcome the problem that a conventional safety socket has a bulky size.

4 Claims, 8 Drawing Sheets

SHIELDING STRUCTURE OF SAFETY SOCKET

(a) TECHNICAL FIELD OF THE INVENTION

The present invention generally relates to an improved shielding structure of a safety socket, and more particularly to an improved shielding structure of a safety socket that has a simple structure, occupies a reduced amount of space, has improved adaptability, and helps protect against risk of electric shock resulting from improper use.

(b) DESCRIPTION OF THE PRIOR ART

In a normal condition of use, an electric socket is kept in a state of constantly supplying electricity. In other words, the insertion slots of the socket are not blocked and are in an open condition. Events of electric shock often occur for children holding and inserting a metal foreign object into the insertion slots of the electric socket and body damage may thus result. To avoid the occurrence of such events, manufacturers have marketed an insulation material comprising at least two prongs to be inserted into the insertion slots of an electric socket in order to block the insertions of the foreign objects, or alternatively, a slide lid is additionally provided on a surface where the insertion slots are formed so that when the electric socket is not in use, the slide lid can be moved to make through holes thereof not in alignment with the insertion slots so as to prevent the insertion of the foreign objects. The protection achieved with such two solutions is generally located outside the socket and there is still risk that they may be unexpectedly overcome by children and thus they are of insufficient protection for safety.

Referring to FIG. 1, which is a perspective view of a conventional safety socket, the drawing clearly shows the illustrated design is an electric socket 9 in which a shielding plate 91 is mounted. This arrangement, although greatly improving safety of use, increases the manufacture cost and also increases the overall size of the socket 9 in order to provide a retraction space 92 for the shielding plate 91, whereby the convenience of use is greatly affected.

Such a socket 9 still suffers the following drawbacks to be improved in the use thereof:

(1) The safety protection is not good enough and can be easily overcome by a child.

(2) The size is extremely bulky, making the use inconvenient.

Thus, it is a challenge of the present inventor and the manufacturers of this field to provide a solution to overcome the above discussed problems and shortcomings.

SUMMARY OF THE INVENTION

In view of the above problems, the present invention aims to provide an improved shielding structure of a safety socket that comprises a built-in movable safety shielding plate, requires no additional space, and has a small size.

An object of the present invention is that when hot/neutral slots of a safety socket simultaneously receive plug prongs to insert therein, a movable shielding member arranged in the safety socket is caused to move toward the top of the safety socket and when the plug prongs are withdrawn, the movable shielding member is returned by elasticity of an elastic element to shield the hot/neutral slots. There is no need to provide an additional space below the hot/neutral slots for accommodating the movement of the movable shielding member.

To achieve the above object, the present invention provides a structure that comprises: hot/neutral slots that are formed in a bottom of a safety socket, a movable shielding member that is arranged in the safety socket to correspond to the hot/neutral slots, and an elastic element having opposite ends respectively fixed to the movable shielding member and a top of the safety socket. When a user uses the present invention, the present invention has an outside appearance that is similar to the conventional devices and comprises a movable shielding member arranged therein to correspond to the hot/neutral slots, so as to provide shielding against people making an unexpectedly contact and thus achieve protection. In a normal condition of use, with a fixing section that supports the elastic element being arranged on a top of the safety socket, a moving direction of the movable shielding member is changed to move toward the center so that there is no need to provide, besides the hot/neutral slots, an additional space for accommodating the movement of the movable shielding member.

With the above technique, the problems that in a conventional safety socket, an insulation plug may be easily removed or get readily lost and a safety slide lid does not provide complete protection and a conventional shielding member requires a large space for accommodation can be overcome to achieve the desired purpose discussed above.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
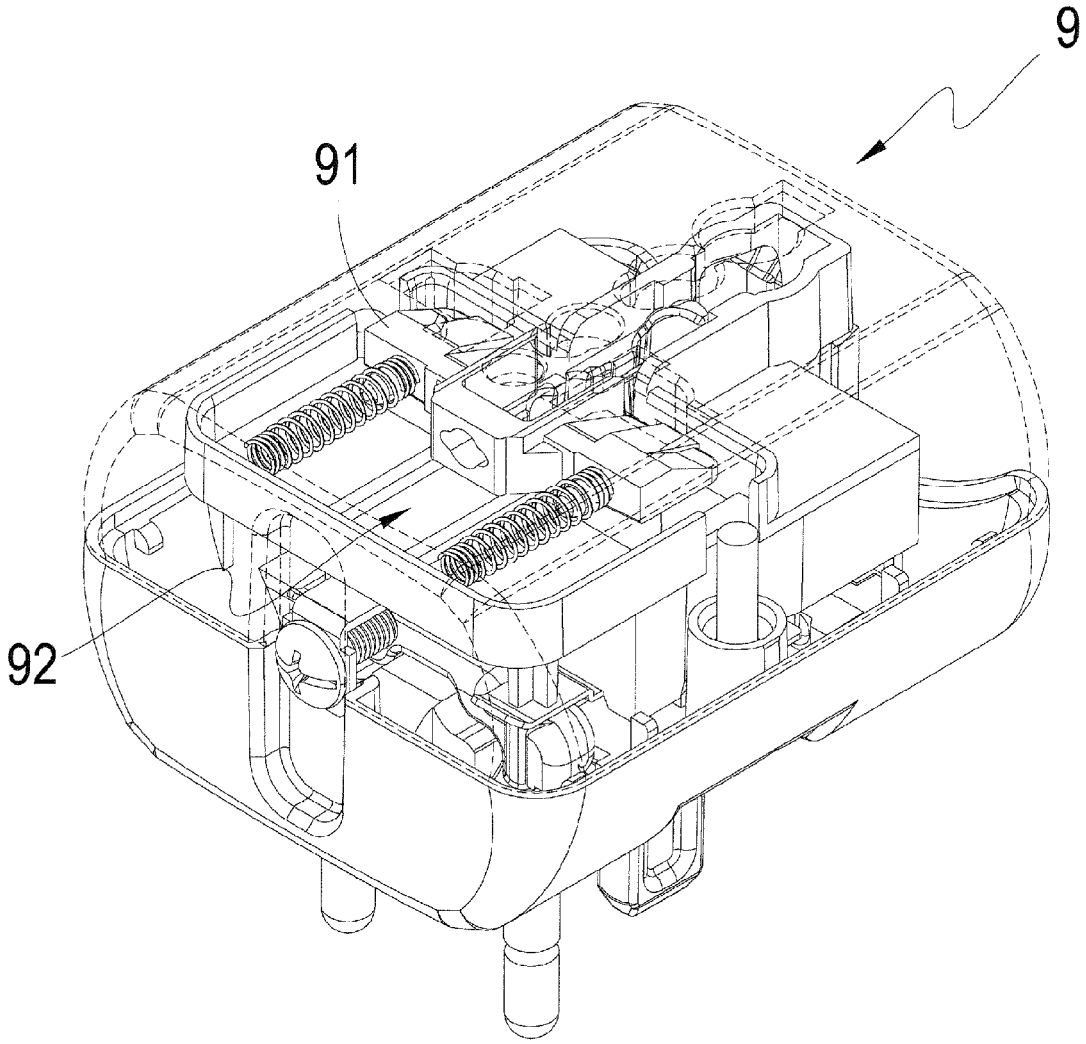
PRIOR ART FIG. 1
FIG. 1 is a perspective view showing a conventional safety socket.
Figure 2:
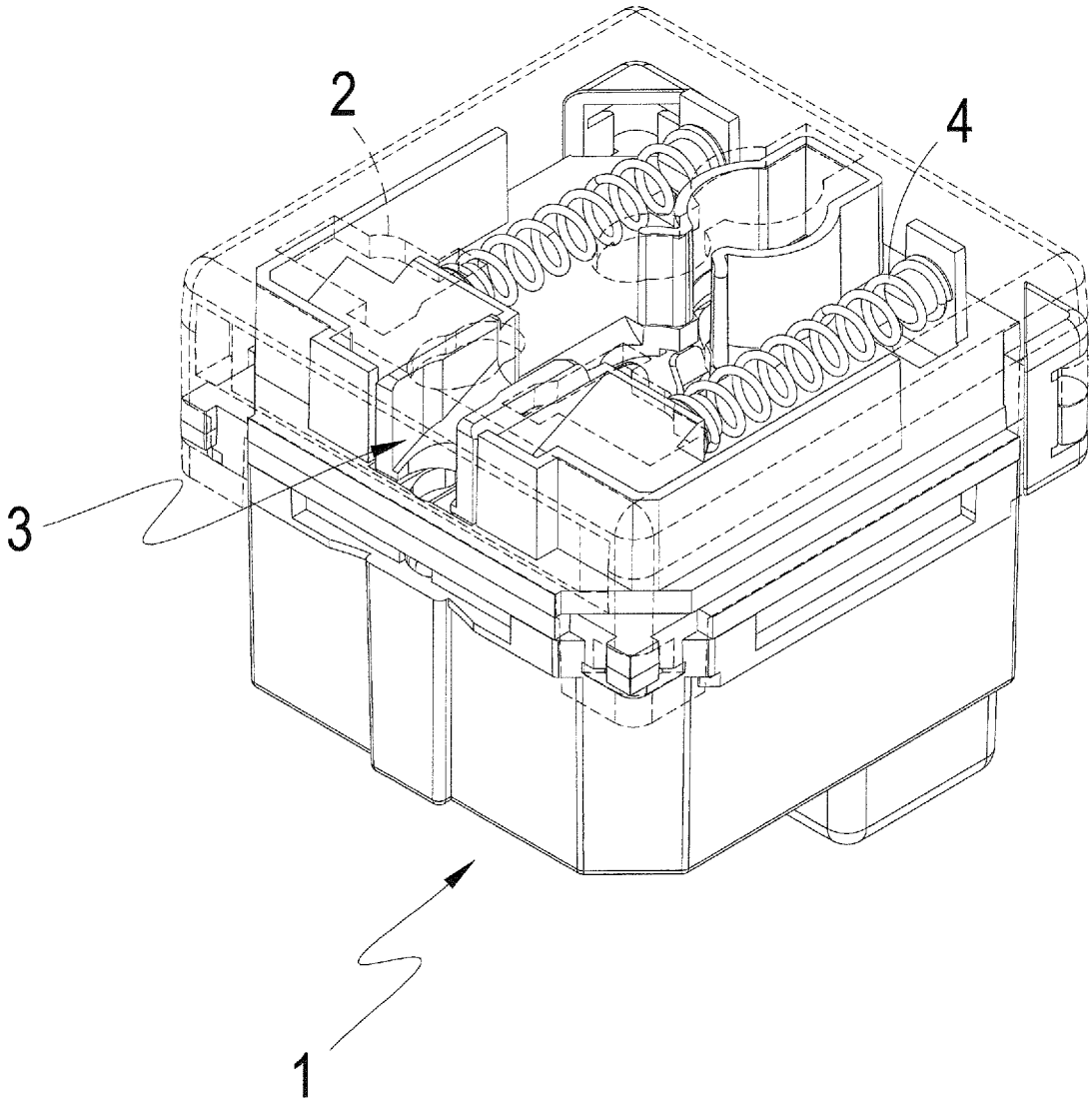
FIG. 2 is a perspective view of a preferred embodiment of the present invention.
Figure 3:
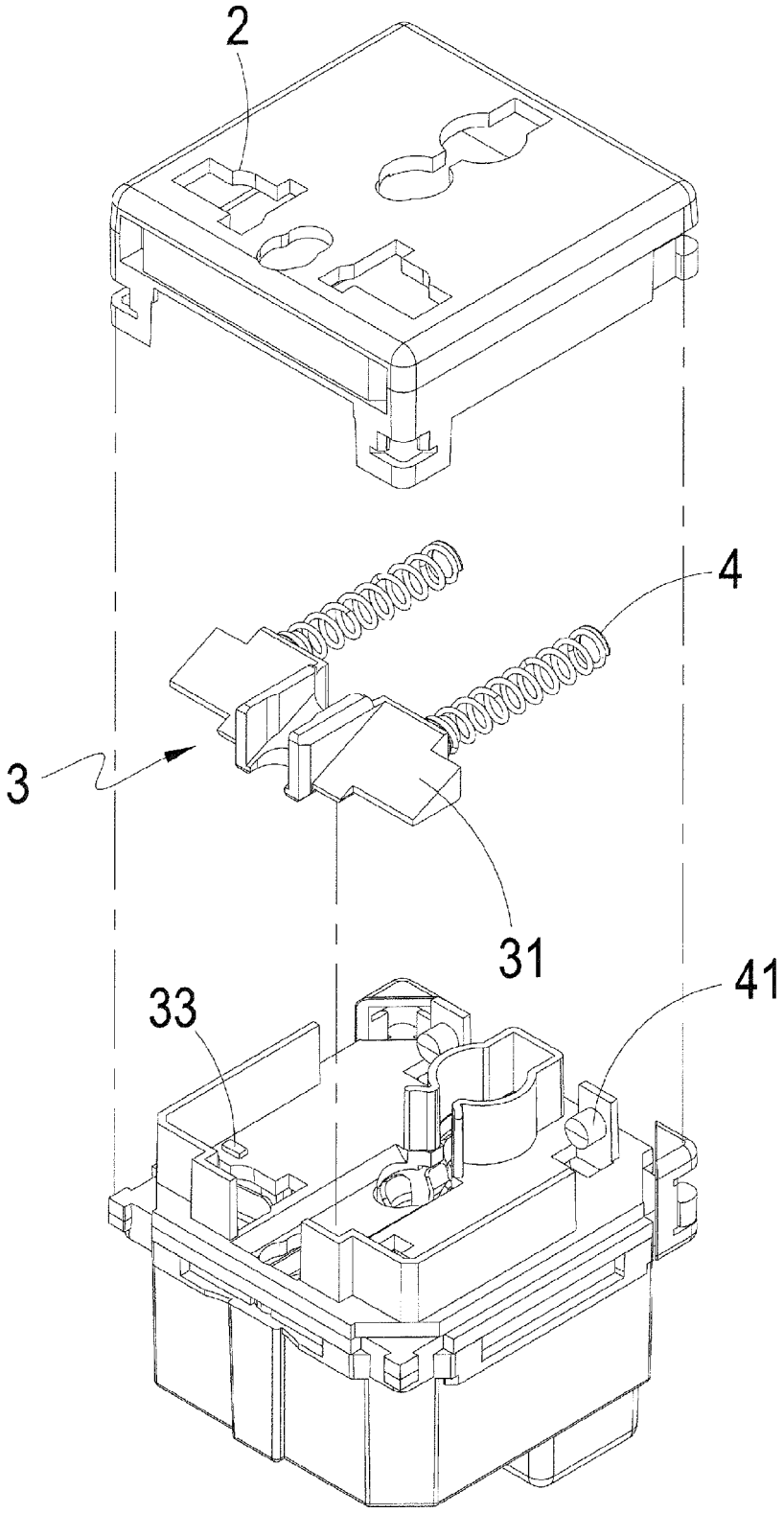
FIG. 3 is an exploded view of the preferred embodiment of the present invention.
Figure 4:
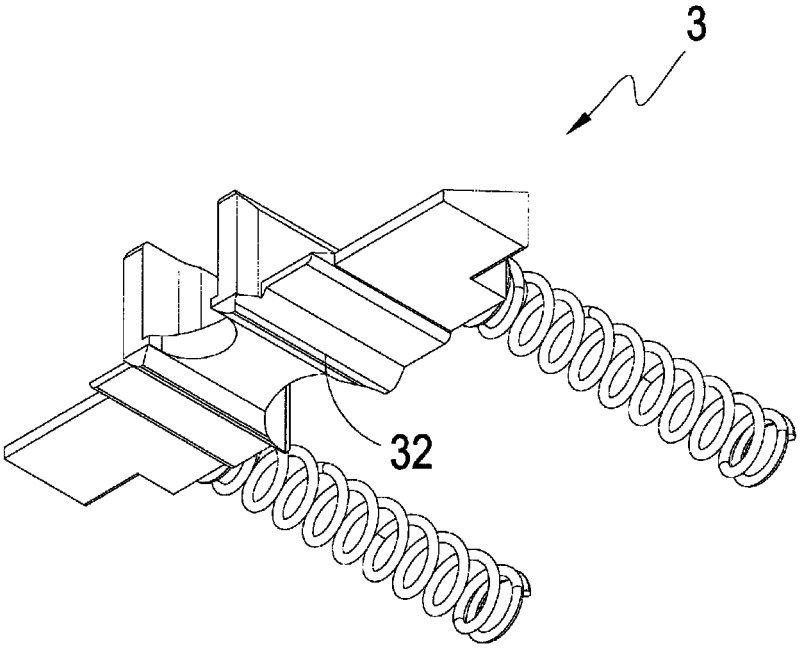
FIG. 4 is a perspective view showing a movable shielding member of the present invention.
Figure 5:
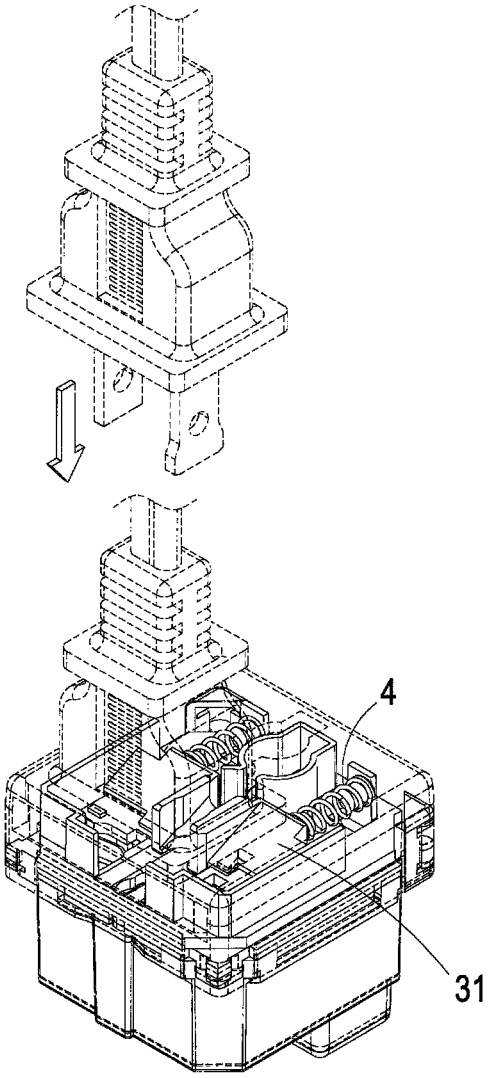
FIG. 5 is a schematic view illustrating an operation of the preferred embodiment of the present invention.

Referring to FIGS. 2, 3, and 4, which are respective a perspective view and an exploded view of a preferred embodiment of the present invention and a perspective view of a movable shielding member of the preferred embodiment of the present invention, the drawings clearly show that the present invention comprises:

hot/neutral slots 2 that are formed in a bottom of the safety socket 1;

a movable shielding member 3 that is arranged in the safety socket 1 to correspond to the hot/neutral slots 2, the movable shielding member 3 comprising two push-to-move sections 31 that are simultaneously contactable by two plug prongs to allow the movable shielding member 3 to be pushed away and a balance section 32 that causes the movable shielding member 3 to incline when the two push-to-move sections 31 are not acted upon by consistent forces and further comprising a constraint section 33 that is arranged besides the movable shielding member 3 in such a way that the constraint section 33 allows the movable shielding member 3 in a horizontal state to pass therethrough and constraints the movement when the movable shielding member 3 is in an inclined state; and an elastic element that is associated with each of the push-to-move sections and has two ends respectively fixed to the movable shielding member 3 and a top of the safety socket 1, the elastic element 4 being provided with at least one fixing section 41 associated with the end thereof distant from the movable shielding member 3.

Figure 6:
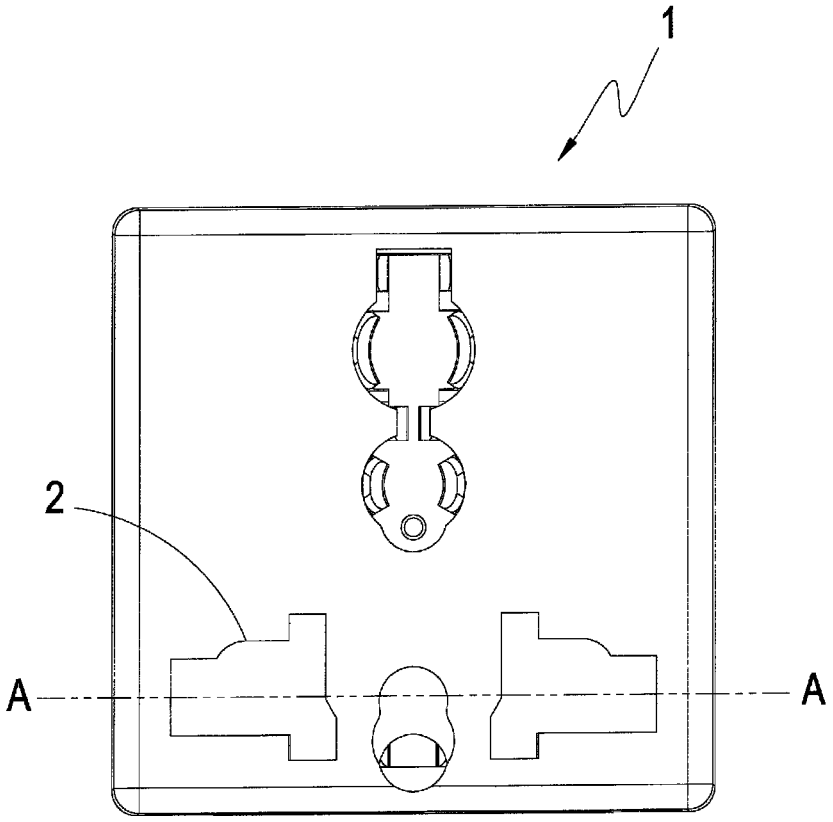
FIG. 6 is a top view of the preferred embodiment of the present invention.
Figure 7:
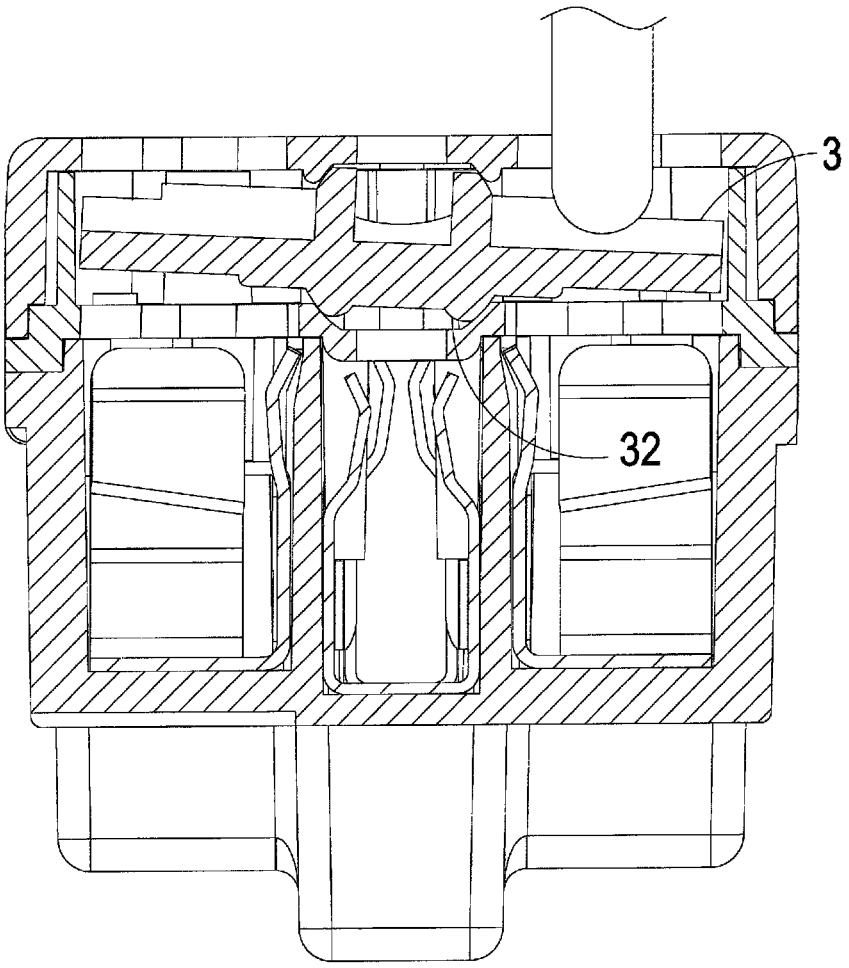
FIG. 7 is a cross-sectional view taken along line A-A of FIG. 6.
Figure 8:
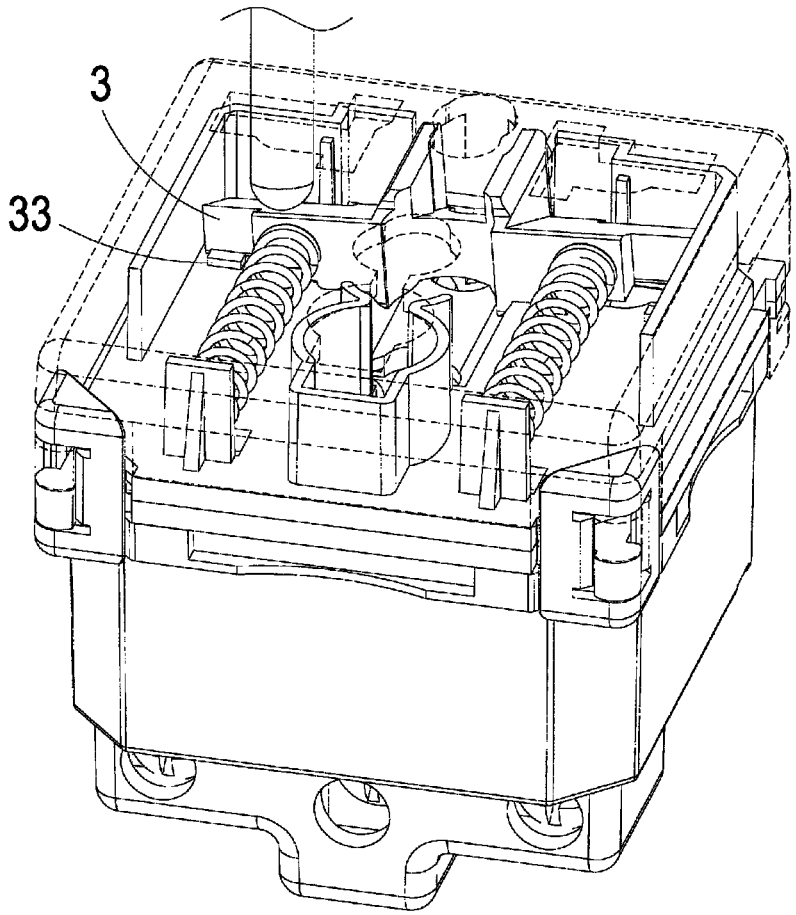
FIG. 8 is a schematic view illustrating a condition of use of the preferred embodiment of the present invention.

Also referring to FIGS. 2-8, which are respective a perspective view and an exploded view of a preferred embodiment of the present invention, a perspective view of a movable shielding member of the preferred embodiment of the present invention, a schematic view illustrating an operation of the preferred embodiment of the present invention, a top view of the preferred embodiment of the present invention, a cross-sectional view taken along line A-A of FIG. 6, and a schematic view illustrating a condition of use of the preferred embodiment of the present invention, these drawings clearly show that with the above component properly assembled, a user may clearly identify that the hot/neutral slots 2 are located at the bottommost part of the safety socket 1 and it is possible to see, through the hot/neutral slots 2, the movable shielding member 3 that constructs blockade in the interior of the safety socket 1, rather than providing protection by externally mounting an insulation plug or a slide lid. Thus, the outside appearance of the safety socket 1 is not obviously altered.

When a user uses the present invention, in a regular condition of use, although the hot/neutral slots 2 are blocked by the movable shielding member 3, when two plug prongs are simultaneously inserted into the hot/neutral slots 2, the plug prongs first contact the push-to-move sections 31 of the movable shielding member 3. The push-to-move sections 31 each have a slope, which, when acted up normally by a force, converts an external force applied in a vertical direction by the associated one of the plug prongs into a push force in a horizontal direction, so that the movable shielding member 3 is moved by such forces. Since the movable shielding member 3 is arranged to correspond to the hot/neutral slots 2 and is thus also located at the bottommost part of the safety socket 1, the movable shielding member 3 is only allowed to move in a direction toward the top of the safety socket 1. Under such a condition, the elastic element 4 of which the two ends are respectively fixed to the movable shielding member 3 and the fixing section 41 is compressed and thus shortened and is allowed to restore with the elasticity thereof upon withdrawal of the plug prongs, whereby the movable shielding member 3 may block and shield the hot/neutral slots 2. As such, when the push-to-move sections 31 are acted upon by external forces in a uniform manner, the movable shielding member 3 is moved and leaves a space for normal use by the user. The space that is needed for the movement of the movable shielding member 3 is limited below the hot/neutral slots 2, so that there is no need to provide a devoted space for such movement and there is also no need for expansion of the size. Thus, the present invention has the advantages of small size and easy use.

In a case of being undesired contacted by a child or other abnormal situations, a foreign object that is inserted into the hot/neutral slots 2 does not provide two uniform external forces so that the foreign object applies does not uniformly apply forces to the push-to-move sections 31. Although such forces may be converted into horizontal push forces, the movable shielding member 3 are provided on the underside thereof with a balance section 32 and the balance section 32 acts like a support point of a seesaw so that when the two push-to-move sections 31 are not acted upon by external forces in a uniform manner between the left part and the right part, the balance section 32 causes the movable shielding member 3 to incline. Under such a condition, the constraint section 33 that is provided beside the movable shielding member 3 gets into effect. When being in a horizontal and non-inclined state, the movable shielding member 3 is not blocked or stopped by the constraint section 33. However, when the movable shielding member 3 is inclined due to non-uniform application of the external forces to the push-to-move sections 31, the constraint section 33 blocks the moving path of and thus stops the movable shielding member 3. As such, when the two push-to-move sections 31 are not uniformly acted upon by external forces, the movable shielding member 3 may block a foreign object outside to achieve the purpose of safety protection.

Thus, with reference being had to all the drawings, the present invention, when put into operation, shows the following advantages as compared to the known devices:

The movable shielding member 3 is arranged in the socket so that there is no need to externally mount an insulation plug or a slide lid, which are solutions that may get lost or overcome by children.

Besides the panel surface needed for the hot/neutral slots 2, the outside appearance of the safety socket 1 requires no addition of a moving space for the movable shielding member 3 so as to effectively reduce the size thereof.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A shielding structure of a safety socket, comprising:

a first slot and a second slot that are formed in a first portion of the safety socket and adapted to respectively receive two prongs of a plug to insert therein;

a movable shielding member that is movably arranged in the safety socket and comprises two push-to-move sections to respectively correspond to the first and second slots, the two push-to-move sections each defining a slope formed on a first surface of the movable shielding member, the slopes corresponding to the first and second slots and spaced from each other in a first direction, the movable shielding member further comprising a balance section formed on an opposite second surface and located between the slopes of the two push-to-move sections to support the push-to-move sections in such a manner that the two push-to-move sections are normally kept in a balanced condition and are allowed to incline sideways when the push-to-move sections are acted upon by external forces in a non-uniform manner; and an elastic element that has opposite ends respectively fixed to the movable shielding member and a top of the safety socket to normally bias toward a first position where the push-to-move sections respectively shield the first and second slots, wherein when the first and second slots simultaneously receive the plug prongs to insert therein, the slopes of the push-to-move sections are simultaneously acted upon by the plug prongs in such a manner that the two push-to-move sections are supported on the balance section in a mutually balanced condition to allow the movable shielding member to move from the first position, in a second direction that is different from the first direction, toward a second position, where the movable shielding member is located in a second portion of the safety socket to open the first and second slots, and when the plug prongs are withdrawn, the movable shielding member is returned by elasticity of the elastic element from the second position to the first position to shield the first and second slots.

2. The shielding structure of the safety socket according to claim 1, wherein at least one constraint section is formed beside the movable shielding member.

3. The shielding structure of the safety socket according to claim 2, wherein the constraint section is arranged to allow the movable shielding member in the mutually balanced condition to pass and to stop movement of the movable shielding member in an inclined state.

4. The shielding structure of the safety socket according to claim 1, wherein the elastic element is associated with at least one fixing section at an end thereof that is distant from the movable shielding member.

* * * * *